US007972163B2

(12) United States Patent
Chen et al.

(10) Patent No.: US 7,972,163 B2
(45) Date of Patent: Jul. 5, 2011

(54) ELECTRICAL CONNECTOR HAVING LATCHING MECHANISM

(75) Inventors: Hung-Chuan Chen, Taoyuan Hsien (TW); Chin-Hsing Lin, Taoyuan Hsien (TW); Hung-Chang Hsieh, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 151 days.

(21) Appl. No.: 12/489,979

(22) Filed: Jun. 23, 2009

(65) Prior Publication Data

US 2010/0003844 A1 Jan. 7, 2010

(30) Foreign Application Priority Data

Jul. 1, 2008 (TW) ..... 97124754 A

(51) Int. Cl.
*H01R 13/627* (2006.01)

(52) U.S. Cl. ..... 439/350

(58) Field of Classification Search ..... 439/350, 439/358, 357, 352, 488
See application file for complete search history.

(56) References Cited

U.S. PATENT DOCUMENTS

| | | | | |
|---|---|---|---|---|
| 6,354,860 | B1 * | 3/2002 | Miller et al. | 439/352 |
| 6,461,186 | B1 * | 10/2002 | Endo | 439/352 |
| 7,326,074 | B1 * | 2/2008 | Lim et al. | 439/352 |
| 7,335,048 | B1 * | 2/2008 | Chen et al. | 439/358 |
| 7,591,668 | B2 * | 9/2009 | Nakamura | 439/489 |
| 7,762,854 | B1 * | 7/2010 | Peng | 439/752 |
| 2008/0124966 | A1 * | 5/2008 | Lim | 439/357 |
| 2009/0035980 | A1 * | 2/2009 | Nakamura | 439/352 |

FOREIGN PATENT DOCUMENTS

CN 2749118 Y 12/2005

* cited by examiner

*Primary Examiner* — T C Patel
*Assistant Examiner* — Phuongchi T Nguyen
(74) *Attorney, Agent, or Firm* — Kirton & McConkie; Evan R. Witt

(57) ABSTRACT

An electrical connector includes a plurality of pins, an isolation body and a latching mechanism. The isolation body includes a receiving part. The receiving part is arranged at a front edge of the isolation body and has a first engaging element. The latching mechanism has a second engaging element engaged with the first engaging element, so that the latching mechanism is fixed onto the isolation body.

17 Claims, 6 Drawing Sheets

2

4

ELECTRICAL CONNECTOR HAVING LATCHING MECHANISM

FIELD OF THE INVENTION

The present invention relates to an electrical connector, and more particularly to an electrical connector having a latching mechanism.

BACKGROUND OF THE INVENTION

Electrical connectors are widely used in most electrical appliance for making electrical connection between two electronic components or two electrical appliances. For example, a so-called serial advanced technology attachment (SATA) connector is mounted on a cable end of an electrical appliance such as a hard disc, a computer peripheral storage device or a power supply apparatus. Via such a connector, this electrical appliance can be electrically connected to another electronic appliance such as a host computer.

Referring to FIG. 1, a schematic perspective view of a conventional electrical connector is illustrated. The electrical connector 1 of FIG. 1 comprises an isolation body 10, a sheltering body 11 and a plurality of pins 12. The electrical connector 1 is mounted on the cable end of an electrical appliance to be coupled with corresponding electrical connector of another electrical connector so as to make electrical connection between these two electrical appliances. The isolation body 10 is detachably coupled to the sheltering body 11, and a channel 14 is defined within the isolation body 10. The plurality of pins 12 are received within the channel 14 and have first ends coupled to cables 13. The second ends of the pins 12 are exposed to the entrance 15 of the channel 14 to be coupled with corresponding pins of the electrical connector of another electrical appliance.

Please refer to FIG. 1 again. The electrical connector 1 further includes a latching mechanism 16 on the upper side 10*a* of the isolation body 10. The latching mechanism 16 includes a connecting part 16*a*, a suppressing part 16*b* and at least a fastening part 16*c*.

The connecting part 16*a* of the latching mechanism 16 has a front end fixed on the upper side 10*a* and in the vicinity of the periphery of the entrance 15. The connecting part 16*a* is substantially a slant ascending toward the rear side thereof. The sheltering body 11 has a hollow portion 17 corresponding to the latching mechanism 16. In response to a depressing force exerted on the suppressing part 16*b*, the suppressing part 16*b* is partially received in the hollow portion 17. In addition, two stopping blocks 18 are protruded from the upper side 10*a* of the isolation body 10, and a raised block 19 is protruded from the upper side 11*a* of the sheltering body 11. For combining the isolation body 10 with the sheltering body 11, the isolation body 10 is inserted into the channel portion of the sheltering body 11 and then the stopping blocks 18 is penetrated through the hollow portion 17. Under this circumstance, the isolation body 10 is securely engaged with the sheltering body 11 by the stopping blocks 18, and the latching mechanism 16 is located in the vicinity of the raised block 19. Since the latching mechanism 16 is partially enclosed by the stopping blocks 18 and the raised block 19, the latching mechanism 16 is protected from being damaged or erroneously touched by the foreign components.

The fastening parts 16*c* of the latching mechanism 16 are arranged on the connecting part 16*a*. Once the electrical connector 1 is coupled with corresponding electrical connector (not shown) of another electrical appliance, the fastening parts 16*c* are engaged with the fastening parts (not shown) of the corresponding electrical connector so as to enhance secure attachment between these two electrical connectors. For coupling these two electrical connectors, a depressing force is exerted on the suppressing part 16*b* of the latching mechanism 16 such that the fastening part 16*c* is slightly lowered to be engaged with the fastening parts (not shown) of the corresponding electrical connector to enhance secure attachment between these two electrical connectors. Whereas, for detaching these two electrical connectors from each other, a depressing force is exerted on the suppressing part 16*b* of the latching mechanism 16, such that the fastening parts 16*c* are slightly lowered to be disengaged from the fastening parts (not shown) of the corresponding electrical connector.

The structure of the electrical connector 1 still has some drawbacks. For example, the process of assembling the isolation body 10 and the sheltering body 11 is complicated. As shown in FIG. 1, the front end of the latching mechanism 16 is fixed on the upper side 10*a* in the vicinity of the periphery of the entrance 15 and ascends toward the rear side thereof. In addition, the fastening parts 16*c* of the latching mechanism 16 are arranged on the connecting part 16*a* and proximate the front end of connecting part 16*a*. Therefore, the shift amount of the fastening parts 16*c* is small in response to the external force exerted on the suppressing part 16*b*. In other words, it is laborious to lower the fastening parts 16*c* in order to couple or detach these two electrical connectors. Moreover, the stopping blocks 18 and the raised block 19 increase structural and assembling complexity.

Therefore, there is a need of providing an electrical connector having a latching mechanism so as to obviate the drawbacks encountered from the prior art.

SUMMARY OF THE INVENTION

It is an object of the present invention to provide an electrical connector having a latching mechanism to be mounted on the cable end of an electrical appliance in order to be electrically connected to corresponding electrical connector of another electronic appliance.

Another object of the present invention provides an electrical connector, which is simple in structure and easily assembled.

A further object of the present invention provides an electrical connector having a latching mechanism for facilitating easy attachment and detachment of the electric connector and a corresponding electrical connector.

In accordance with an aspect of the present invention, there is provided an electrical connector. The electrical connector includes a plurality of pins, an isolation body and a latching mechanism. The isolation body includes a receiving part. The receiving part is arranged at a front edge of the isolation body and has a first engaging element. The latching mechanism has a second engaging element engaged with the first engaging element, so that the latching mechanism is fixed onto the isolation body.

In accordance with another aspect of the present invention, there is provided an electrical connector for coupling with an electrical connector of an electrical appliance. The electrical connector comprises a plurality of pins, an isolation body and a latching mechanism. The pins have first ends coupled to multiple cables. The isolation body includes a receiving part. The receiving part is arranged at a front edge of the isolation body and has a first engaging element. The latching mechanism has a second engaging element engaged with the first engaging element, so that the latching mechanism is fixed onto the isolation body.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
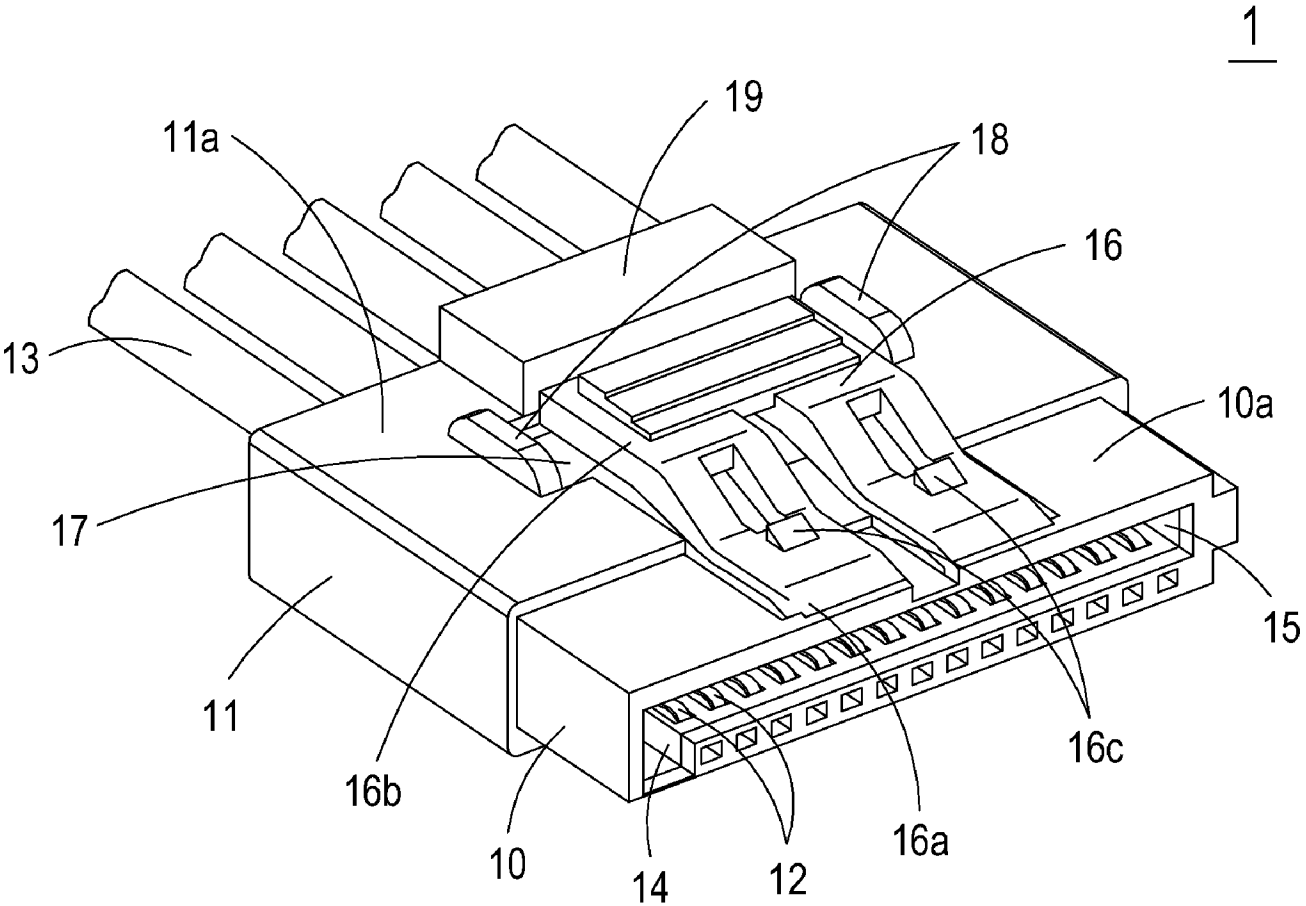
FIG. 1 PRIOR ART
FIG. 1 is a schematic perspective view of a conventional electrical connector.
Figure 2:
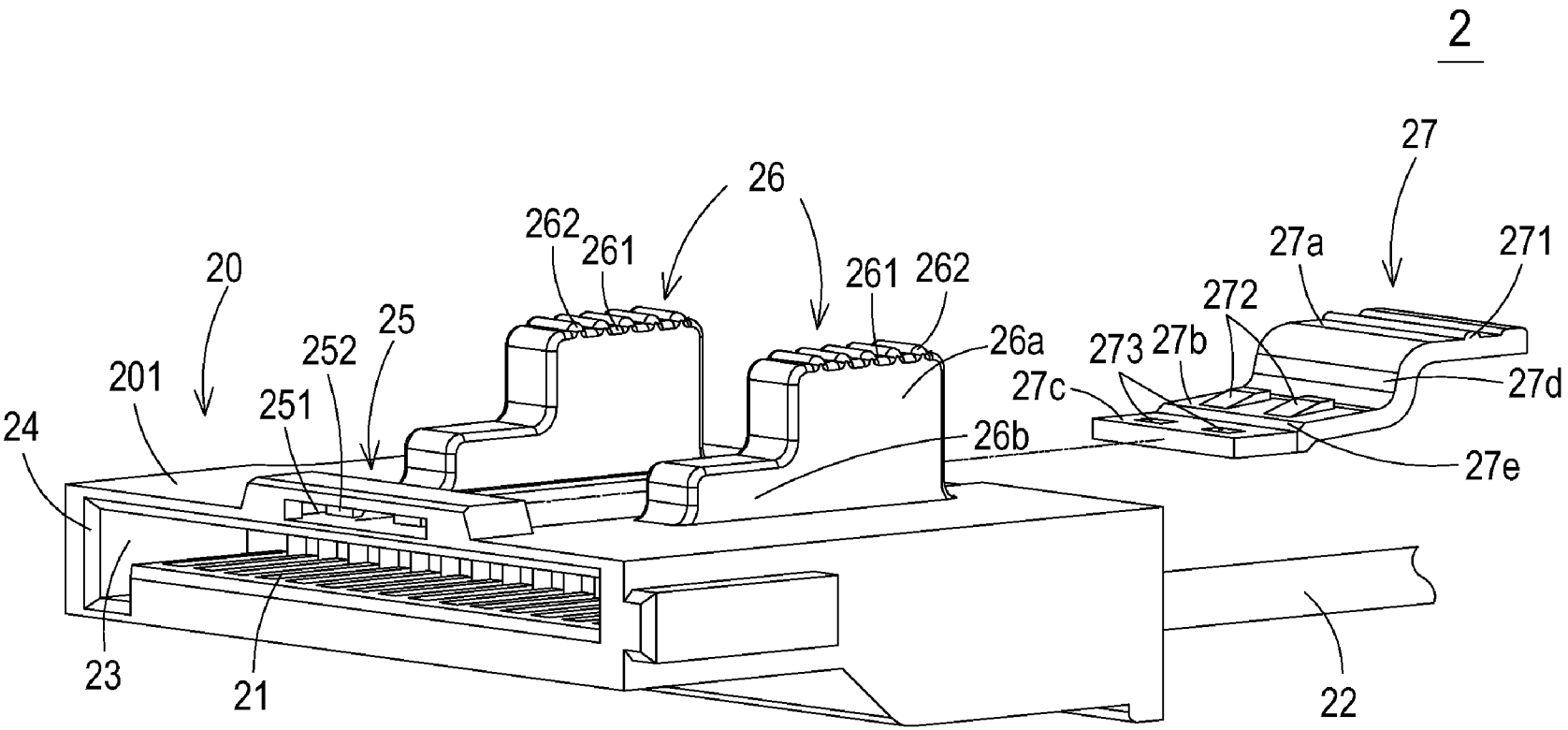
FIG. 2 is a schematic perspective view illustrating an electrical connector having a latching mechanism according to a preferred embodiment of the present invention.

FIG. 2 is a schematic perspective view illustrating an electrical connector having a latching mechanism according to a preferred embodiment of the present invention. As shown in FIG. 2, the electrical connector 2 principally comprises an isolation body 20 and a plurality of pins 21. The electrical connector 2 is mounted on the cable end 22 of an electrical appliance such as a hard disc, a computer peripheral storage device or a power supply apparatus. Via this connector 2, this electrical appliance can be electrically connected to corresponding electrical connector (not shown) of another electronic appliance such as a host computer.

Please refer to FIG. 2 again. A channel 23 is defined within the isolation body 20. The plurality of pins 21 are received within the channel 23. The pins 21 have first ends directly or indirectly coupled to cables 22. The second ends of the pins 21 are exposed to the entrance 24 of the channel 23 to be coupled with corresponding pins (not shown) of the electrical connector of another electrical appliance. A receiving part 25 is formed on the upper surface 201 of the isolation body 20. It is preferred that the receiving part 25 is integrally formed with the isolation body 20. The receiving part 25 has a receptacle 251 for accommodating a latching mechanism 27. In addition, at least a first engaging element 252 (e.g. a salient) is formed on a sidewall of the receptacle 251. Corresponding to the first engaging element 252, the latching mechanism 27 has a second engaging element 273 to be engaged with the first engaging element 252.

Please refer to FIG. 2 again. The latching mechanism 27 of the electrical connector 2 is substantially a stepped slab. The isolation body 20 and the latching mechanism 27 are made of plastic material. The latching mechanism 27 includes a suppressing part 27*a*, a fastening part 27*b*, an engaging part 27*c*, a first connecting part 27*d* and a second connecting part 27*e*.

The suppressing part 27*a* has an anti-slip element 271 on a top surface thereof for providing a rough surface to facilitate the user to recognize a proper force-exerting position so as to exert the external force. In this embodiment, the anti-slip element 271 has several horizontal ribs. Alternatively, the anti-slip element 271 has several V-shaped grooves. The structures of the anti-slip element 271 may be modified as required.

The first connecting part 27*d* is interconnected between the suppressing part 27*a* and the fastening part 27*b*. The first connecting part 27*d* has a slant surface. In this embodiment, the slant surface of the first connecting part 27*d* is substantially perpendicular to the suppressing part 27*a*.

The fastening part 27*b* includes at least a fastening element 272 (e.g. a fastening block). If no external force is exerted on the latching mechanism 27, the fastening element 272 of the fastening part 27*b* is slightly protruded from the surface of the fastening part 27*b*. The second connecting part 27*e* is interconnected between the fastening part 27*b* and the engaging part 27*c*. The second connecting part 27*e* also has a slant surface. The length of the second connecting part 27*e* is shorter than the first connecting part 27*d*. In addition, there is a height difference between the first connecting part 27*d* and the second connecting part 27*e* such that the suppressing part 27*a* is higher than the fastening part 27*b* and the fastening part 27*b* is higher than the engaging part 27*c*.

The engaging part 27*c* has the second engaging element 273 corresponding to the first engaging element 252 formed on a sidewall of the receptacle 251 of the isolation body 20. In this embodiment, the first engaging element 252 is a salient, and the second engaging element 273 is a recess. When the first engaging element 252 is engaged with the second engaging element 273, the latching mechanism 27 is securely fixed on the isolation body 20.

Figure 3A:
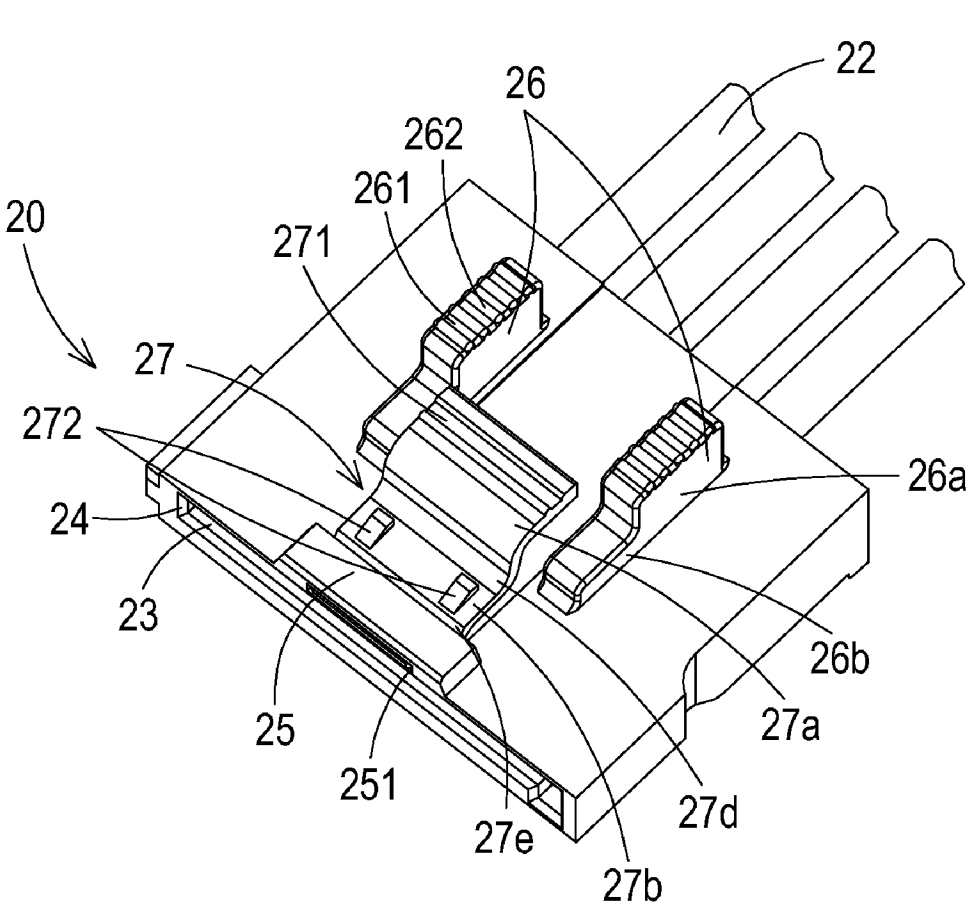
FIG. 3A is a schematic assembled view of the electrical connector shown in FIG. 2.
Figure 3B:
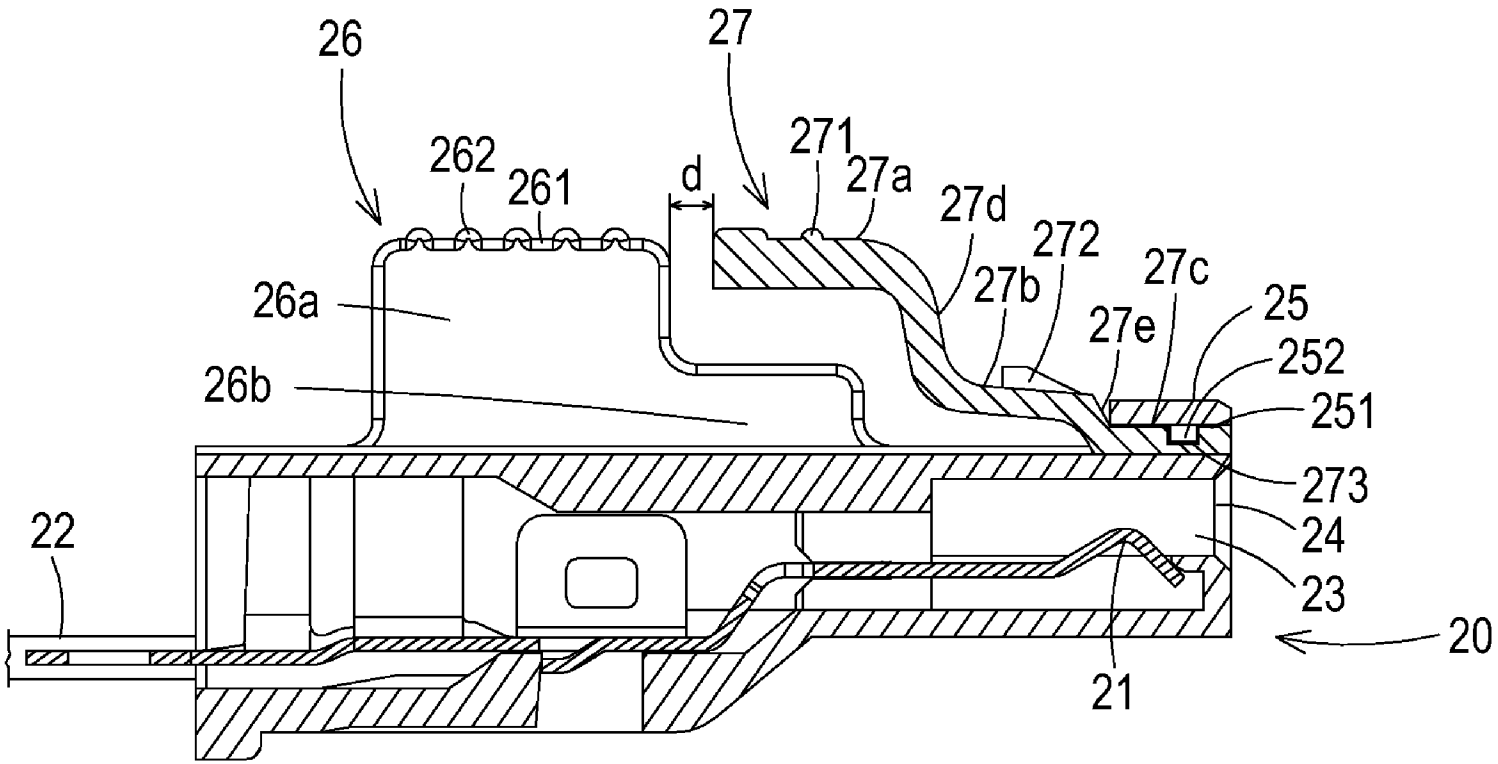
FIG. 3B is a schematic cross-sectional view of the electrical connector shown in FIG. 3A.

FIG. 3A is a schematic assembled view of the electrical connector shown in FIG. 2. FIG. 3B is a schematic cross-sectional view of the electrical connector shown in FIG. 3A. Please refer to FIGS. 3A and 3B. For assembling the latching mechanism 27 with the isolation body 20, the engaging part 27*c* of the latching mechanism 27 is aligned with the receiving part 25 and then the latching mechanism 27 is horizontally pushed toward the receptacle 251 of the receiving part 25. Due to the plastic elasticity of the isolation body 20 and the latching mechanism 27, the first engaging element 252 of the isolation body 2 is engaged with the second engaging element 273 of the latching mechanism 27. Since the engaging part 27*c* is fixed within the receptacle 251 of the receiving part 25, the latching mechanism 27 is securely fixed on the isolation body 20 (as shown in FIG. 3B).

Since the first connecting part 27*d* and the second connecting part 27*e* of the latching mechanism 27 are arranged in two steps, the latching mechanism 27 is very resilient and elastic. In response to a depressing force exerted on the suppressing part 27*a* of the latching mechanism 27, the suppressing part 27*a*, the first connecting part 27*d* and the fastening part 27*b* are moved downwardly. Through the first connecting part 27*d*, the fastening part 27*b* and the second connecting part 27*e*, the depressing force is transmitted to the engaging part 27*c*. Since the second engaging element 273 of the engaging part 27*c* is engaged with the first engaging element 252 of the receiving part 25, the engaging part 27*c* is sustained against the receiving part 25. When the depressing force exerted on the suppressing part 27*a* is eliminated, a counterforce is acted on engaging part 27*c*. The counterforce is successively transmitted to the second connecting part 27*e*, the fastening part 27*b*, the first connecting part 27*d* and the suppressing part 27*a*. As a consequence, the suppressing part 27*a* and the fastening part 27*b* are moved upwardly and returned to their original positions.

Please refer to FIGS. 3A and 3B again. At least a stopping part 26 is disposed on the isolation body 20 for facilitating positioning the latching mechanism 27 and preventing from excessively exerting a depressing force on the latching mechanism 27. In this embodiment, the stopping part 26 includes a two-stepped block. The stopping part 26 includes a first portion 26*a* and a second portion 26*b*. The first portion 26*a* is higher than the second portion 26*b* with respect to the isolation body 20. Similarly, another anti-slip element 262 is formed on a top surface 261 of the first portion 26*a* of the stopping part 26 for providing a rough surface. In this embodiment, the anti-slip element 262 has several horizontal ribs. The anti-slip element 262 is employed for providing a rough surface to facilitate the user to recognize a proper force-exerting position so as to exert the external force. It is preferred that the first portion 26*a* is integrally formed with the isolation body 20. Since the latching mechanism 27 is partially enclosed by the second portion 26*b*, the latching mechanism 27 is protected from being damaged or erroneously touched by the foreign components. In addition, as shown in FIG. 3B, there is a gap d between the first portion 26*a* of the stopping part 26 and the suppressing part 27*a* of the latching mechanism 27. In response to a depressing force exerted on the suppressing part 27*a* of the latching mechanism 27, the suppressing part 27*a* and the user's finger are simultaneously moved downwardly. Until the user's finger touches the anti-slip element 262 of the stopping part 26, the depressing force fails to be continuously exerted on the suppressing part 27*a*. In other words, the arrangement of the first portion 26*a* of the stopping part 26 may hinder the user from exerting an excessive depressing force on the suppressing part 27*a*, thereby protecting the latching mechanism.

Figure 5:
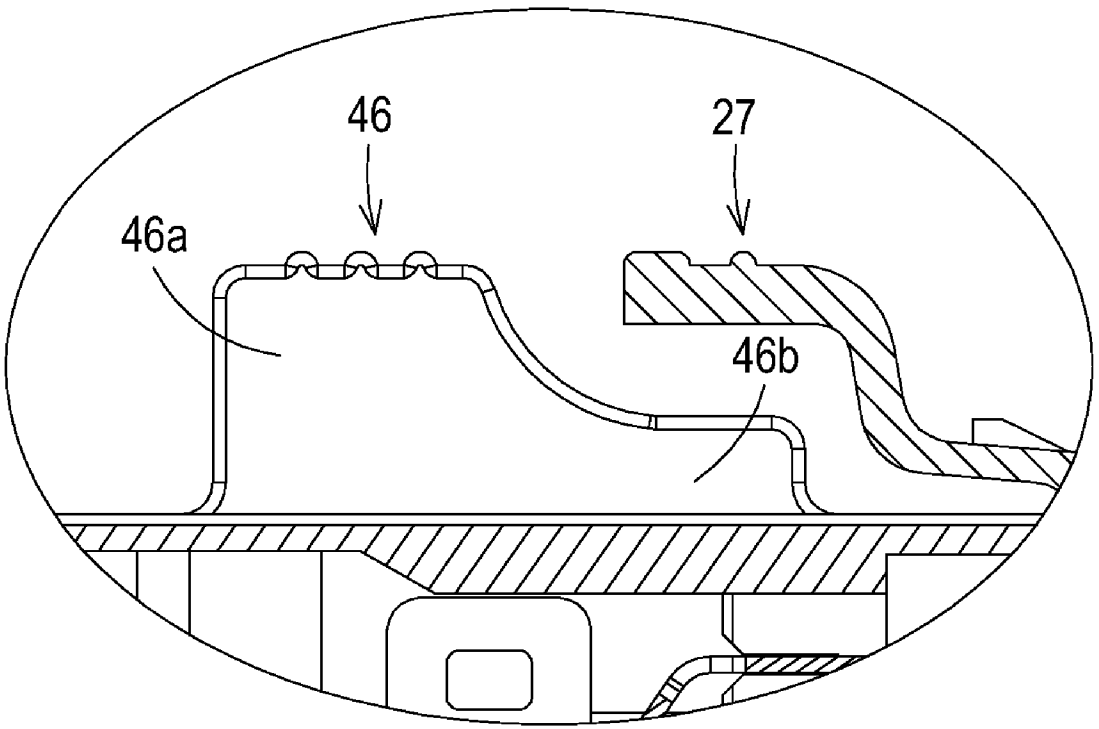
FIG. 5 is a schematic cross-sectional view illustrating another exemplary stopping part used in the electrical connector of the present invention.

It is noted that, however, those skilled in the art will readily observe that numerous modifications and alterations of the stopping part may be made while retaining the teachings of the invention. For example, as shown in FIG. 5, the stopping part 46 of the electrical connector 4 includes a first portion 46*a* and a second portion 46*b*. In addition, the first portion 46*a* has a curved structure to be connected with the second portion 46*b*. The arrangement of the first portion 46*a* of the stopping part 46 may hinder the user from exerting an excessive depressing force on the suppressing part. In addition, the curved structure may increase smoothness and touch feel upon pressing the suppressing part of the latching mechanism.

Figure 4:
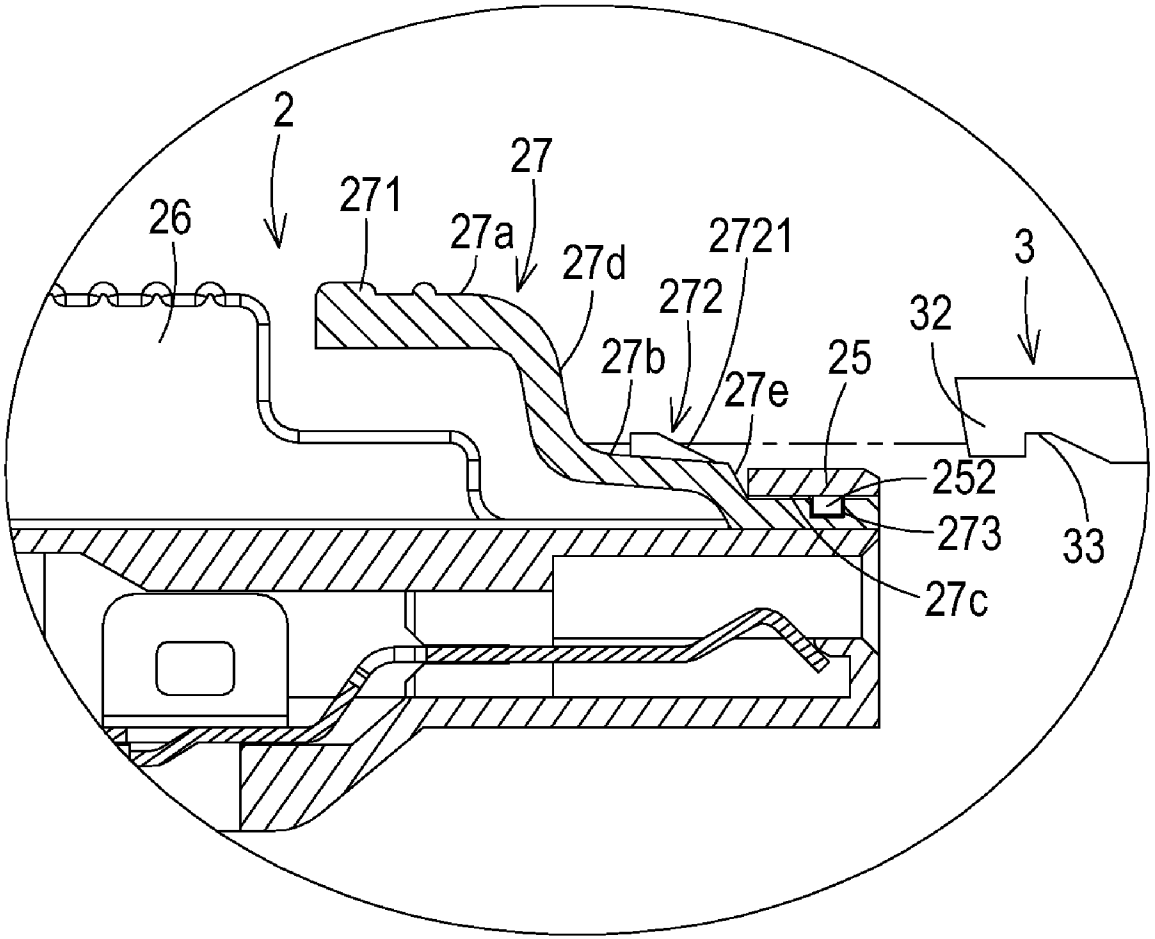
FIG. 4 is a schematic cross-sectional view illustrating the connection between the electrical connector shown in FIG. 3B and a corresponding electrical connector.

FIG. 4 is a schematic cross-sectional view illustrating the connection between the electrical connector shown in FIG. 3B and a corresponding electrical connector. A process of coupling the electrical connector 2 with the electrical connector 3 will be illustrated as follows. Firstly, the electrical connector 3 is pushed toward the electrical connector 2 such that the front edge 32 of the electrical connector 3 is sustained against the fastening element 272 of the fastening part 27*b*. As the front edge 32 of the electrical connector 3 is advanced, the fastening part 27*b* is moved downwardly such that the depressing force is transmitted to the second connecting part 27*e* and the engaging part 27*c*. Until the fastening element 272 of the fastening part 27*b* is engaged with the fastening element 33 (e.g. an indentation) of the electrical connector 3, a secure attachment and an electrical connection between the electrical connector 2 and the electrical connector 3 are rendered. During these two electrical connectors are coupled with each other, no extra external force is required to be exerted on the latching mechanism 27 because the fastening part 27*b* is depressed by the front edge 32 of the electrical connector 3.

Hereinafter, a process of detaching the electrical connector 2 from the electrical connector 3 will be illustrated as follows with reference to also FIGS. 3A, 3B and 4. First of all, in response to a depressing force exerted on the suppressing part 27*a* of the latching mechanism 27, the depressing force is transmitted to the fastening part 27*b* through the suppressing part 27*a* and the first connecting part 27*d*. At the same time, the suppressing part 27*a* and the fastening part 27*b* are moved downwardly such that the fastening element 272 of the fastening part 27*b* is disengaged from the fastening element 33 of the electrical connector 3. Under this circumstance, these two electrical connectors 2 and 3 may be detached from each other. In some embodiments, the fastening element 272 of the fastening part 27*b* has a slant surface 2721 for facilitating engagement between the fastening element 272 and the fastening element 33 or disengagement of the fastening element 272 from the fastening element 33.

From the above description, the electrical connector of the present invention can be mounted on the cable end of an electrical appliance in order to be electrically connected to corresponding electrical connector of another electronic appliance. In comparison with the prior art, the electrical connector of the present invention is simple in structure and easily assembled. The two-stepped slab of the latching mechanism can provide elasticity for facilitating easy attachment between the present electric connector and a corresponding electrical connector and easy detachment of the present electric connector from the corresponding electrical connector. Moreover, the arrangement of the stopping part 26 may hinder the user from exerting an excessive depressing force on the suppressing part, thereby protecting the latching mechanism.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An electrical connector comprising:

a plurality of pins;

an isolation body comprising a receiving part, wherein said receiving part is arranged at a front edge of said isolation body and having a first engaging element; and a latching mechanism having a second engaging element engaged with said first engaging element, so that said latching mechanism is fixed onto said isolation body;

wherein said latching mechanism comprises a suppressing part, a fastening part, an engaging part, a first connecting part and a second connecting part, said first connecting part is interconnected between said suppressing part and said fastening part, said second connecting part is interconnected between said fastening part and said engaging part, said first connecting part is longer than said second connecting part, said latching mechanism is substantially a stepped slab, said suppressing part is higher than said fastening part, said fastening part is higher than said engaging part, and said isolation body further includes at least a stopping part to hinder a user from exerting an excessive depressing force on said suppressing part.

2. The electrical connector according to claim 1 wherein said receiving part is integrally formed with said isolation body.

3. The electrical connector according to claim 1 wherein said suppressing part has an anti-slip element on a top surface thereof.

4. The electrical connector according to claim 1 wherein said second engaging element is arranged on said engaging part and engaged with said first engaging element of said receiving part, so that said engaging part is accommodated in said receiving part and said latching mechanism is fixed onto said isolation body.

5. The electrical connector according to claim 1 wherein said stopping part is integrally formed with said isolation body.

6. The electrical connector according to claim 1 wherein said stopping part is a two-stepped block.

7. The electrical connector according to claim 1 wherein said receiving part further comprises a receptacle.

8. The electrical connector according to claim 7 wherein said first engaging element is a salient formed on a sidewall of said receptacle.

9. The electrical connector according to claim 1 wherein said fastening part further includes at least a fastening element.

10. The electrical connector according to claim 9 wherein said fastening element is a fastening block, which is slightly protruded from a surface of said fastening part and has a slant surface.

11. The electrical connector according to claim 1 wherein a channel is defined within said isolation body, and said pins are received within said channel.

12. The electrical connector according to claim 11 wherein said pins have first ends coupled to multiple cables and second ends disposed within said channel and adjacent to an entrance of said channel.

13. The electrical connector according to claim 12 wherein said isolation body are disposed on distal ends of said cables.

14. The electrical connector according to claim 1 wherein said stopping part includes a first portion and a second portion, and said first portion is higher than said second portion with respect to said isolation body.

15. The electrical connector according to claim 14 wherein another anti-slip element is formed on a top surface of said first portion of said stopping part.

16. The electrical connector according to claim 14 wherein there is a gap between said first portion of said stopping part and said latching mechanism.

17. An electrical connector for coupling with an electrical connector of an electrical appliance, said electrical connector comprising:

a plurality of pins having first ends coupled to multiple cables;

an isolation body comprising a receiving part, wherein said receiving part is arranged at a front edge of said isolation body and having a first engaging element; and a latching mechanism having a second engaging element engaged with said first engaging element, so that said latching mechanism is fixed onto said isolation body;

wherein said latching mechanism comprises a suppressing part, a fastening part, an engaging part, a first connecting part and a second connecting part, said first connecting part is interconnected between said suppressing part and said fastening part, said second connecting part is interconnected between said fastening part and said engaging part, said first connecting part is longer than said second connecting part, said latching mechanism is substantially a stepped slab, said suppressing part is higher than said fastening part, said fastening part is higher than said engaging part, and said isolation body further includes at least a stopping part to hinder a user from exerting an excessive depressing force on said suppressing part.

* * * * *